US005778021A

United States Patent [19]

Innvær

[11] Patent Number: 5,778,021

[45] Date of Patent: Jul. 7, 1998

[54] SELF-BAKING CARBON ELECTRODE

[75] Inventor: Reidar Innvær, Kristiansand, Norway

[73] Assignee: Elkem ASA, Norway

[21] Appl. No.: 602,848

[22] PCT Filed: Jul. 7, 1995

[86] PCT No.: PCT/NO95/00123

§ 371 Date: Feb. 28, 1996

§ 102(e) Date: Feb. 28, 1996

[87] PCT Pub. No.: WO96/03849

PCT Pub. Date: Feb. 8, 1996

[30] Foreign Application Priority Data

Jul. 21, 1994 [NO] Norway ..... 942724

[51] Int. Cl.[6] ..... H05B 7/06

[52] U.S. Cl. ..... 373/89; 373/97; 204/286; 204/294

[58] Field of Search ..... 373/88, 89, 90, 373/91, 92, 93, 97, 98; 204/286, 294

[56] References Cited

U.S. PATENT DOCUMENTS

| | | | |
|---|---|---|---|
| 1,723,582 | 8/1929 | Sem . | |
| 3,595,977 | 7/1971 | Orlando | 373/89 |
| 3,819,841 | 6/1974 | Persson | 373/89 |
| 4,424,584 | 1/1984 | Evensen | 373/97 |
| 4,527,329 | 7/1985 | Bruff et al. . | |
| 4,575,856 | 3/1986 | Persson . | |
| 4,692,929 | 9/1987 | Cavigli et al. . | |
| 4,756,813 | 7/1988 | Stanley | 373/89 |

FOREIGN PATENT DOCUMENTS

| | | |
|---|---|---|
| 43079 | 12/1927 | Norway . |
| 45408 | 7/1928 | Norway . |
| 149451 | 4/1984 | Norway . |

*Primary Examiner*—Tu B. Hoang
*Attorney, Agent, or Firm*—Bierman, Muserlian and Lucas

[57] ABSTRACT

The invention relates to a self-baking carbon electrode produced in direct connection with the furnace wherein it is consumed. The electrode comprises an outer casing made from an electrical conducting material, and having inner radial, vertical ribs. Carbonaceous unbaked paste is supplied to the casing, which paste is being baked to a solid electrode by means of electric current supplied to the electrode. The inner radial, vertical ribs consist of solid carbon sheets being affixed to the inside of the casing, said carbon sheets having a ratio between radial length and thickness of above 5:1.

12 Claims, 4 Drawing Sheets

SELF-BAKING CARBON ELECTRODE

CROSS REFERENCE TO RELATED APPLICATIONS

This application was filed pursuant to 35 USC 371 based on International Application No. PCT/NO95/00123 filed Jul. 7, 1995 which claimed the priority of Norwegian Application No. 942724 filed Jul. 21, 1994.

TECHNICAL FIELD

The present invention relates to a self-baking electrode for use in electrical smelting furnaces.

BACKGROUND ART

Conventional self-baking electrodes comprise a vertically arranged electrode casing extending through an opening in the furnace roof or hood. The upper end of the electrode casing is open in order to allow addition of unbaked carbonaceous electrode paste which upon heating soften and melts and is thereafter baked into a solid carbon electrode due to heat evolved in the paste in the area of supply of electric operating current to the electrode. As the electrode is consumed in the furnace the electrode is lowered and new sections of casing are installed on the top of the electrode column and further unbaked electrode paste is added.

The conventional electrode of this type is equipped with inner, vertical metallic ribs affixed to the inner surface of the electrode casing which ribs extend radially towards the center of the electrode. When a new section of electrode casing is installed at the top of the electrode column, the ribs are welded to the ribs in the casing below in order to obtain continuous ribs in vertical direction. The ribs serve as a reinforcement of the baked electrode and to conduct electric current and heat radially into the electrode paste during the baking process. To compensate for the consumption of the electrode the electrode is lowered downwardly into the furnace by means of electrode holding and slipping means.

When conventional electrodes of this type are used, the electrode casing and the inner ribs melt when the electrode is being consumed in the furnace. The metal content of the casing and the ribs is thus transferred to the product produced in the smelting furnace. As the electrode casing and the inner ribs usually are made from steel, such conventional self-baking electrodes can not be used for electrical smelting furnaces for the production of silicon or for the production of ferro-silicon having a high silicon content, as the iron content in the produced product will become unacceptably high.

Already in the 1920's it was proposed to conduct heat into self-baking electrodes through inserts of prebaked carbon bodies in the unbaked electrode paste. Thus in Norwegian patent No. 45408 it is disclosed a method for production of self-baking electrodes where prebaked carbon bodies are placed in the periphery of the electrodes and kept in place by the unbaked carbon paste. The carbon inserts are not affixed to the electrode casing, but are only kept in place by the unbaked electrode paste, and when the electrode is baked, by the baked electrode paste. In order to keep the carbon inserts in place before, during and after baking of the electrode paste, it is a necessary that each casing is completely filled with hot liquid electrode paste when a new length of casing is installed at the top of the electrode column, as it is only the electrode paste that keep the carbon inserts in place against the inside wall of the casing. Such a method for adding electrode paste is unwanted as gases hazardous to health which evolve from the tar/pitch binder in the electrode paste, will vaporize from the top of the electrode column and will then be an unacceptable health hazard to the operators. The carbon inserts shown in the Norwegian patent have a ratio between radial length and thickness of less than 1:2. The carbon inserts will therefore conduct heat only a short length inwardly into the electrode paste and thereby make it difficult to obtain complete baking in the central part of the electrode. As the carbon inserts according to Norwegian patent no. 45408 are not affixed to the casing or to one another in vertical direction and in addition have a ratio between radial length and thickness of less than 1:2, these carbon inserts will not function in the same way as the inner ribs which are used in conventional self-baking electrodes. The method according to Norwegian patent No. 45408 has for these reasons not found any practical use.

It has, however, during the years been proposed a number of modifications of conventional self-baking carbon electrodes having inner steel ribs in order to avoid contamination of silicon produced in the furnace with iron from the iron in the casing and in the ribs.

Thus, in Norwegian patent No. 149451 it is disclosed a self-baking electrode where electrode paste contained in a casing having no inner ribs, is being baked above the place where electric operating current for the smelting furnace is supplied to the electrode, and where the electrode casing is removed after baking of the electrode, but before the electrode has been lowered down to the place where electric operating current is supplied to the electrode. In this way an electrode having no casing and no inner ribs is produced.

This kind of electrode has been used in smelting furnaces for the production of silicon, but has the disadvantage compared to conventional prebaked electrodes that costly devices have to be installed for baking of the electrode and for removing the casing from the electrode.

In U.S. Pat. No. 4,692,929 it is disclosed a self-baking electrode for use with electric furnaces for production of silicon. The electrode comprises a permanent metal casing having no internal ribs and a support structure for the electrode comprising carbon fibres, where the electrode paste is baked about the support structure and where the baked electrode is being held by the support structure. This electrode has the disadvantage that special holding devices have to be arranged above the top of the electrode in order to hold the electrode by means of the support structure comprising carbon fibres. Further, it can be difficult to slip the electrode down through the permanent casing as the electrode is consumed.

In U.S. Pat. No. 4,575,856 it is described a self-baking electrode having a permanent casing with no inner ribs, where the electrode paste is being baked about a central core of graphite and where the electrode is being held by the graphite core. This electrode has the same disadvantages as the electrode according to U.S. Pat. No. 4,692,929, and in addition the graphite core is subjected to breakage when the electrode is subjected to radial forces.

The above mentioned methods for production of self-baking electrode having no inner metal ribs all suffer from the disadvantage that they cannot be used for electrodes having a diameter above 1.2 m without a substantial increase in the probability of breakage. Contrary to this, conventional self-baking electrodes having a diameter of up till 2.0 m are used.

DISCLOSURE OF INVENTION

Despite the above mentioned methods and apparatuses for production of self-baking electrodes in order to avoid iron contamination of the product produced in the smelting furnace, there is still a need for a simple and reliable self-baking carbon electrode, where the disadvantages of the known electrodes may be overcome. It is thus an object of the present invention to provide a self-baking carbon electrode having no inner steel ribs, but where the disadvantages of the electrode disclosed in Norwegian patent No. 45488 are overcome.

Accordingly, the present invention relates to a self-baking carbon electrode produced in direct connection with the furnace wherein it is consumed, which electrode comprises an outer casing made from an electrical conducting material, and having inner radial, vertical ribs and where carbonaceous unbaked paste is supplied to the casing, which paste is being baked to a solid electrode by means of electric current supplied to the electrode, said electrode being characterized in that the inner radial, vertical ribs consist of solid carbon sheets being affixed to the inside of the casing, said carbon sheets having a ratio between radial length and thickness of above 5:1.

The carbon sheets can be made from graphite or from prebaked carbon material, and may be reinforced by carbon fibres or by fibres of other materials which will not contaminate the product produced in the smelting furnace. The ratio between radial length and thickness of the carbon sheets is decided based on the type of carbon material used and the strength of the carbon material.

If the carbon sheets are made from prebaked carbon material, the carbon ribs preferably have a ratio between radial length and thickness above 8:1. If the carbon sheets are made from graphite, the carbon ribs preferably have a ratio between radial length and thickness of above 15:1.

According to a preferred embodiment of the present invention the carbon ribs are affixed to the casing by means of bolts and/or by glueing.

The casing having carbon ribs is manufactured in substantially the same way as the casing for self-baking electrodes having steel ribs. Each length of casing can thus be produced from sections where the total number of sections are equal to the number of carbon ribs. Each section of the casing is at least on one of its vertical sides equipped with an inwardly extending flange. When assembling a mantel length, the carbon ribs are affixed between the vertical flanges on adjacent sections by means of bolts and nuts and/or by gluing. Alternatively each length of casing can be produced of welded cylinder-shaped sheets having vertical flanges welded to its inside for affixing the carbon ribs.

The carbon ribs have a vertical extension which is at least equal to the length of each length of casing. Preferably the carbon ribs have a length which exceeds the length of casing by up to 50 cm. When mounting new length of casing on the top of the electrode the carbon ribs in the new length of casing will thus overlap the carbon ribs in the length of casing below. When electrode paste is being baked in the area between two lengths of casing it is thereby obtained a vertical contact between the carbon ribs in the same way as for steel ribs in conventional self-baking electrodes.

In the electrode according to the present invention the ribs made from carbon sheets will have a good electrical conductivity and the electric current supplied to the electrode will be conducted inwardly into the unbaked electrode paste. This is very important in order to ensure a fast baking of the electrode, for example after an electrode breakage.

For big electrode diameters, the ribs are necessary in order to stabilize the current and the heat conditions in the periphery of the electrode. In addition to increasing the current and heat transport the ribs must carry the weight of the electrode. The metal ribs in conventional self-baking electrodes melt and disappear at a temperature of above about 1000° C., while the carbon ribs in the electrode according to the present invention will function as a reinforcement all the way down to the electrode tip. The electrode according to the present invention can thus be used for bigger electrode diameters than the electrodes which today are used in furnaces for production of silicon.

By using ribs of solid carbon sheets having a ratio between radial length and thickness of above 5:1, the contamination of the product produced in the furnace by iron from the ribs is avoided, at the same time as the electrode maintains at least the same mechanical strength as an electrode having steel ribs. This makes it possible to produce electrodes according to the present inventions having as larger diameter as conventional electrodes having steel ribs. Conventional holding- and slipping devices can be used for the electrode according to the present invention. The electrode according to the present invention can thus be used in smelting furnaces presently using self-baking electrodes having steel ribs, without costly modifications of the electrode holding- and slipping devices.

The casing for the electrode according to the present invention can be equipped with a plurality of outer, vertical, metal or carbon ribs whereby the electrode can be held and slipped by the use of electrode holding- and slipping devices described in Norwegian patents Nos. 147168 and 149485. In this way radial forces on the electrode are avoided above the area where the baking of the electrode takes place. Further, by using such electrode holding- and slipping devices, the casing can be made from very thin metal sheets, thereby further reducing iron contamination of the products produced in the smelting furnace. Other metals such as aluminium and aluminium alloys can also be used in the casing. In addition electrodes having a non-circular cross-section, such as electrodes having a rectangular or a substantially rectangular cross-section can be produced.

DETAILED DESCRIPTION OF PREFERRED EMBODIMENTS

Figure 1:
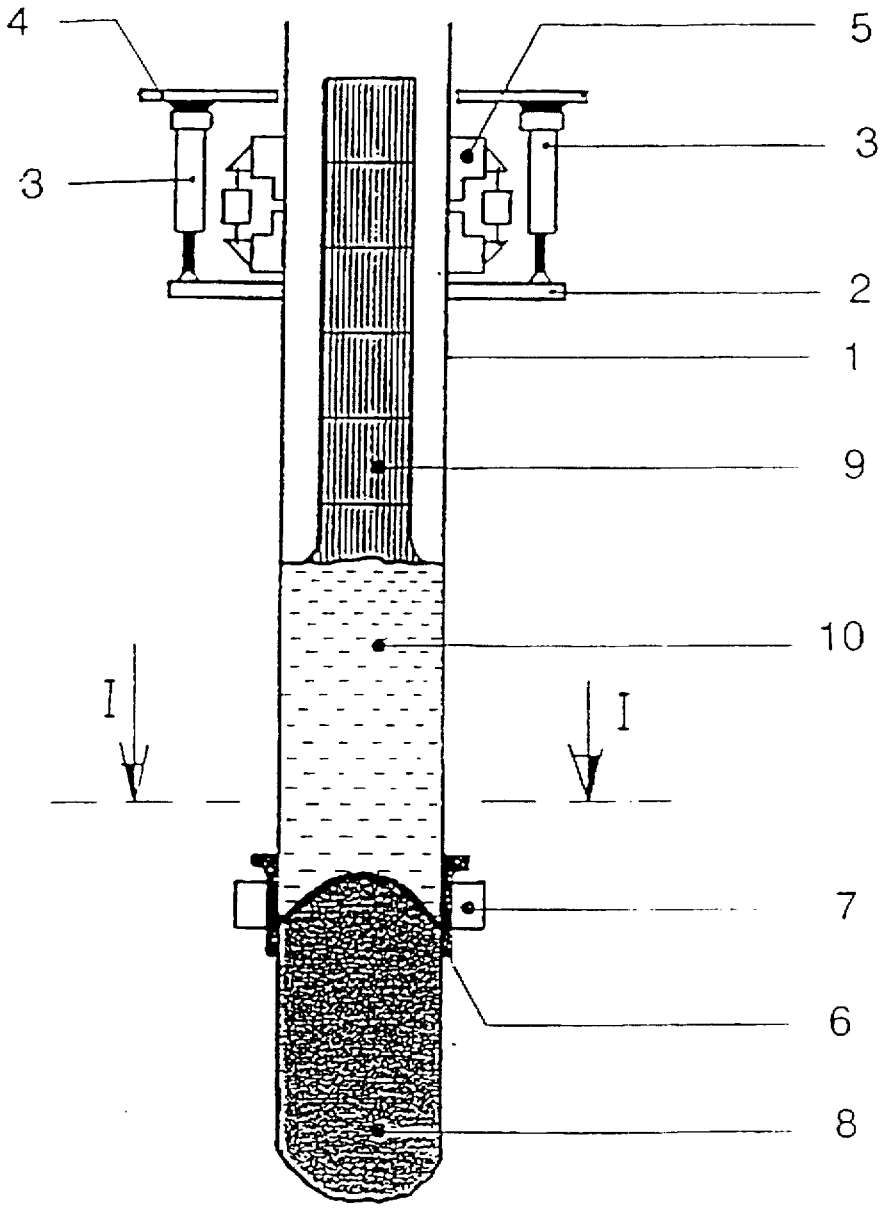
FIG. 1 is vertical cut through the electrode according to the present invention.

In FIG. 1 there is shown a self-baking electrode which is being consumed in a smelting furnace (not shown) situated below the electrode. The electrode comprises an outer casing 1 made from a current conducting material. The casing 1 is through an electrode suspension frame 2 and through hydraulic electrode regulation cylinders 3 suspended in the building construction 4. Conventional electrode holding- and slipping devices 5 are arranged for holding of the electrode and for slipping the electrode downwardly as it is being consumed in the furnace. In the lower part of the electrode there is arranged contact clamps 6 which are pressed against the surface of the electrode by means of a conventional pressure ring 7. The contact clamps 6 are connected to electrical conduits (not shown) in order to supply electric operating current to the electrode. Due to the heat which is generated in the carbonaceous electrode paste, the paste will be heated in the area of current supply and the paste is being baked into a solid electrode 8. The electrode paste is supplied to the top of the electrode casing 1 in the form of solid cylinders 9 and the paste will due to the heat soften and fill the complete cross-section of the electrode casing and form a liquid layer 10 of electrode paste.

Figure 2:
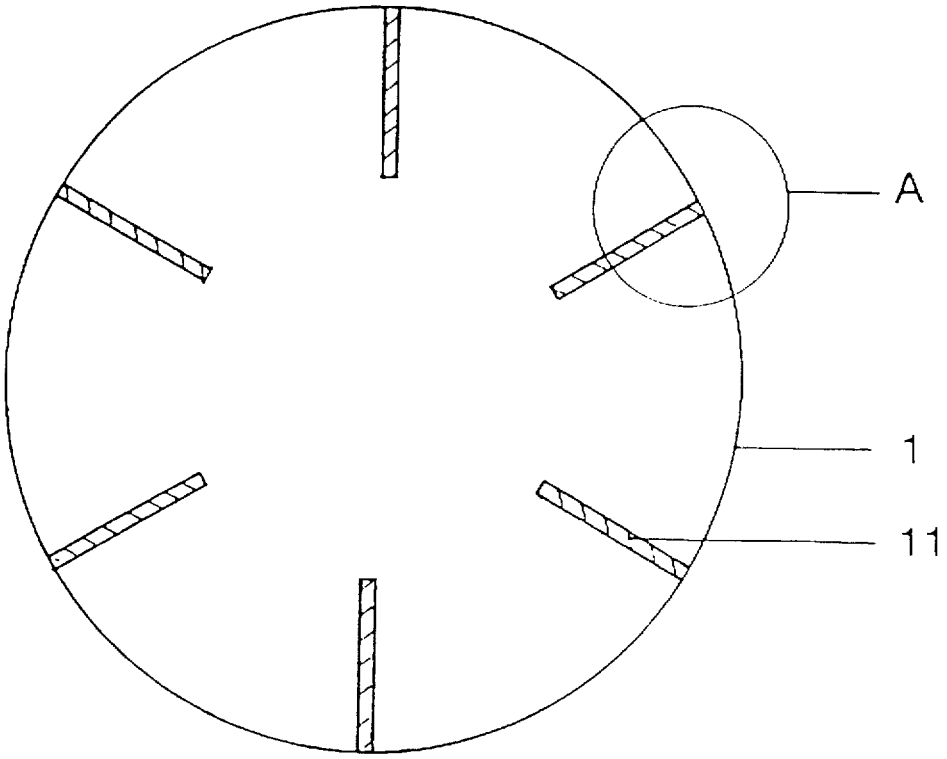
FIG. 2 is horizontal view taken along line I—I in FIG. 1.

The casing 1 shown in FIG. 2 is equipped with a plurality of inner ribs 11 made from graphite sheets having a ratio between radial length and thickness of 20:1. By using ribs 11 made from carbon materials contamination of the product produced in the smelting furnace with iron from steel ribs, is avoided. Also the disadvantages encountered by the known self-baking electrode without radial inner ribs and where it is being used carbon inserts as disclosed in Norwegian patent No. 45408, are avoided. The carbon ribs have such a strength that they are able to carry the weight of the baked electrode and further have a good electric conductivity causing the electric current supplied via the contact clamps 6 to be conducted inwardly into the electrode paste 10 and thereby cause a rapid baking of the electrode. Further, conventional electrode holding and slipping devices can be used without modifications also for the electrode according to the present invention. The electrode according to the present invention can thereby be put into use in a simple and cost efficient way.

Figure 3:
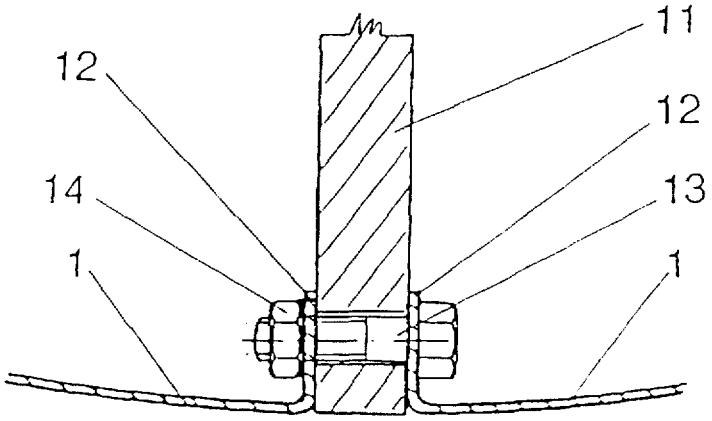
FIG. 3 is an enlarged view of area marked A in FIG. 2 and shows a first embodiment for affixing carbon ribs to the casing.
Figure 4:
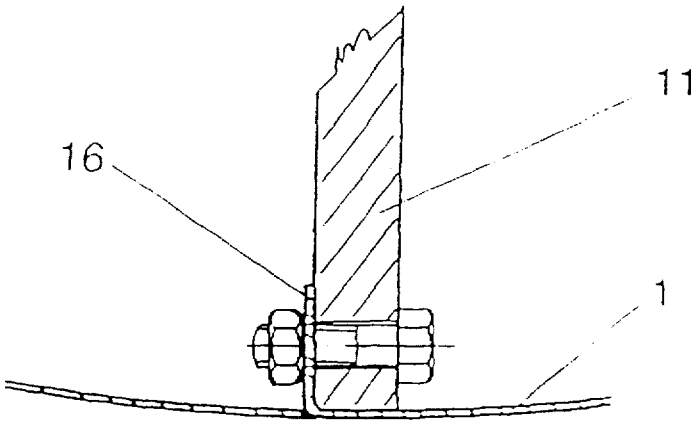
FIG. 4 shows a second embodiment for affixing of carbon ribs to the casing.

Two embodiments for affixing the radial carbon sheets to the electrode casing are shown in FIGS. 3 and 4.

According to the embodiment shown in FIG. 3 individual sections of the electrode casing 1 are equipped with an inwardly extending flange 12. The carbon ribs 11 are affixed between flanges 12 on adjacent sections of electrode casing by means of bolts 13 and nuts 14. In this way the carbon ribs 11 are affixed to the casing in a simple way. In addition glue can be applied on the contact surfaces.

According to the embodiment shown in FIG. 4 the casing is equipped with inwardly extending flanges 16 in a number equal to the number of carbon ribs 11 and the carbon ribs 11 are glued to the flanges 16 by means of a suitable glue. The connection can if necessary be reinforced by means of bolts and nuts.

Figure 5:
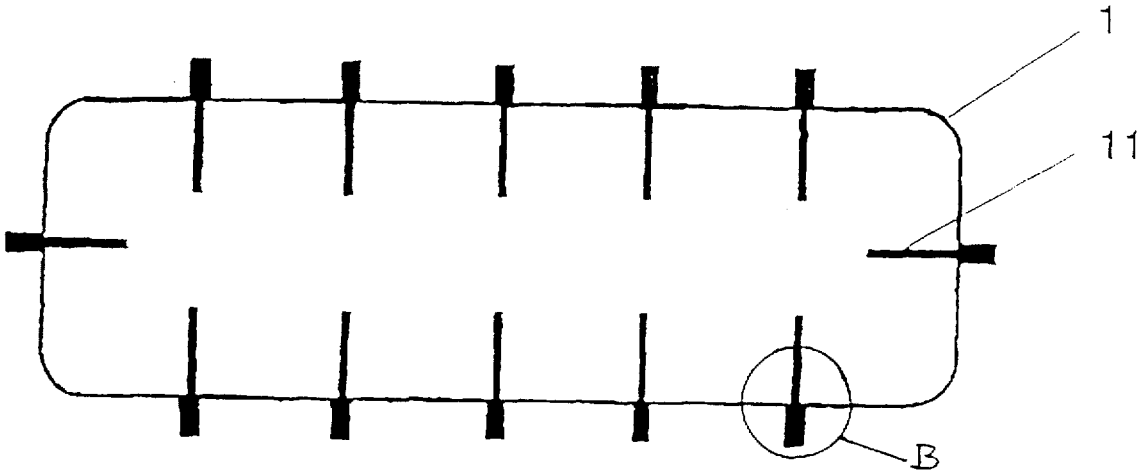
FIG. 5 shows a horizontal cut through an electrode having a rectangular cross-section and being equipped with outer radial ribs, and where.
Figure 6:
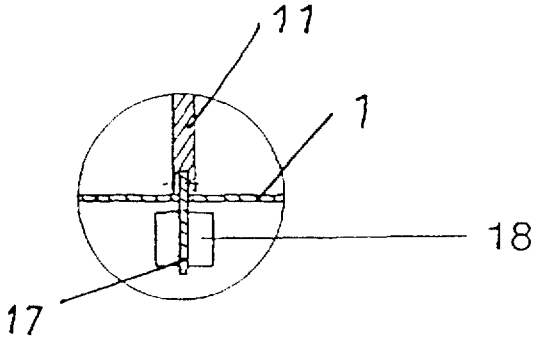
FIG. 6 shows an enlarged view of area marked B in FIG. 5.

In FIGS. 5 and 6 there is shown an embodiment of the present invention where the electrode has substantially rectangular cross-section. For such electrodes conventional electrode holding- and slipping devices shown in FIG. 1 cannot be used. In order to hold the electrode and to supply electric current to the electrode, the electrode casing is, in addition to the inner radial carbon ribs 11, equipped with outer radial ribs 17 made from an electrical conducting material, such as steel, aluminium or carbon. In order to supply electric operating current to the electrode it is used current supply devices 18 which are intended to clamp against the outer ribs 17 in the way described in Norwegian patent No. 147168. In order to hold and to slip the electrode, it is used electrode holding- and slipping devices as described in Norwegian patent No. 147985. This current supply device and the holding- and slipping devices do not impose any radial forces against the electrode casing 1 whereby the casing 1 can be made from a thinner material, which further reduces iron contamination of the product produced in the smelting furnace. The current supply device and the holding- and slipping devices described in Norwegian patents No. 147168 and 147985 can also be used for electrodes having other cross-sections than a rectangular cross-section.

What is claimed:

1. A self-baking carbon electrode produced in direct connection with a furnace wherein it is consumed, wherein said electrode comprises an outer casing (1) made from an electrical conducting material, and having inner radial, vertical ribs (11) and where carbonaceous unbaked paste (9) is supplied to the casing (1), wherein said paste (9) is baked to a solid electrode (8) by means of electric current supplied to the electrode, characterized in that the inner radial, vertical ribs (11) consist of solid carbon sheets (11) being affixed to the inside of the casing (1), said carbon sheets having a ratio between radial length and thickness of above 5:1.

2. Electrode according to claim 1, characterized in that the carbon sheets (11) are made from graphite or from prebaked carbon material.

3. Electrode according to claim 2, characterized in that the carbon sheets (11) made from graphite have a ratio between radial length and thickness of above 15:1.

4. Electrode according to claim 2, characterized in that the carbon sheets (11) made from prebaked carbon material have a ratio between radial length and thickness above 8:1.

5. Electrode according to claims 1, characterized in that the carbon sheets (11) are reinforced by carbon fibers.

6. Electrode according to claims 1, characterized in that the carbon sheets (11) are affixed to the casing (1) by means of bolts (13) and by means of gluing.

7. Electrode according to claim 6, characterized in that the casing (1) comprises a plurality of sections wherein each section has at least on one of its vertical sides an inwardly extending flange (12) and that the carbon sheets (11) are affixed between the flanges (12) on adjacent sections.

8. Electrode according to claims 1, characterized in that the carbon sheets (11) each have a vertical extension which is at least equal to the length of said casing.

9. Electrode according to claim 8, characterized in that the carbon sheets (11) have a length which exceeds the length of casing by up to 50 cm, whereby when a new length of casing is mounted on the top of the electrode, the carbon sheets in the new length of casing will overlap the carbon sheets in the length of casing below the new length of casing.

10. Electrode according to claims 1, characterized in that the electrode casing (1) is equipped with outer, vertical ribs (17) for holding, slipping and supplying electric operating current to the electrode.

11. The electrode according to claim 1 characterized in that the carbon sheets (11) are affixed to the casing (1) by means of bolts (13).

12. The electrode according to claim 1 characterized in that the carbon sheets (11) are affixed to the casing (1) by means of gluing.

* * * * *